United States Patent [19]

Smith

[11] 4,038,997

[45] Aug. 2, 1977

[54] TENT SUPPORT POLE WITH DETACHABLE STRUT AND RIB MEANS

[76] Inventor: John Robert Smith, 21 Aireworth Road, Keighley, Yorks, England

[21] Appl. No.: 610,145

[22] Filed: Sept. 4, 1975

[51] Int. Cl.[2] ..... A45F 1/16

[52] U.S. Cl. ..... 135/15 PQ; 135/3 R; 135/2; 135/28; 135/39; 135/DIG. 8

[58] Field of Search ..... 135/15 PQ, 39, DIG. 8, 135/DIG. 9, 2, 28

[56] References Cited

U.S. PATENT DOCUMENTS

| | | | |
|---|---|---|---|
| 644,737 | 3/1900 | Fry | 135/2 |
| 1,290,245 | 1/1919 | Kuehner | 135/28 |
| 1,520,569 | 12/1924 | Emerson | 135/15 PQ |
| 1,712,430 | 5/1929 | Giszczynski | 135/39 |
| 1,912,564 | 6/1933 | Benson et al. | 135/2 |
| 2,474,516 | 6/1949 | Daniel | 135/28 X |

FOREIGN PATENT DOCUMENTS

| | | | |
|---|---|---|---|
| 677,448 | 8/1952 | United Kingdom | 135/15 PQ |

*Primary Examiner*—Werner H. Schroeder
*Assistant Examiner*—Conrad L. Berman
*Attorney, Agent, or Firm*—Jay L. Chaskin

[57] ABSTRACT

A tent support pole having adjacent one end a plurality of hooks spaced circumferentially around the pole on a fixed collar. A sleeve is slidable on the pole between the hook collar and a fixed stop collar spaced below the hook collar. The sleeve has a like plurality of slots to engage the free end of a tent support strut. The other end of the strut is pivotably connected to a tent support arm and intermediate the ends of the arm. One end of the arm has a bar to engage the hook and the other end a guy securing rope. In use, the bar on the arm is placed on the hook and the free end of the strut is engaged in the sleeve slot. The tent pole is then erected with the top of the pole (i.e., the end adjacent the hooks) projecting through a ring secured to the canvas. The guy ropes are secured to the arm. The sleeve is then moved downwardly toward the stop collar, causing the radially outer end of the arms to be raised and the guy ropes to be fully tensioned to support the canvas.

22 Claims, 5 Drawing Figures

TENT SUPPORT POLE WITH DETACHABLE STRUT AND RIB MEANS

FIELD OF THE INVENTION

This invention relates to tents, and particularly to support structures for tents.

SUMMARY OF THE INVENTION

According to the present invention a support structure for a tent comprises a tent pole and a plurality of support members for use with the pole; the pole having, adjacent to a first end thereof, a plurality of anchoring means spaced apart circumferentially around the pole, stop means secured to the pole and spaced along the pole from the anchoring means, and a sleeve slidable on the pole between the anchoring means and the stop means, the sleeve being formed with a plurality of locating means spaced apart around its circumference; and each support member comprising an arm having an anchoring member at one end and a guy securing element at the other end, and a strut having a first end pivoted to the arm intermediate the ends of the arm and a second end formed with a locating member; the structure being such that when in use each support member may have its anchoring member secured to a respective anchoring means on the pole and its locating member located in a respective one of the locating means on the sleeve.

The support structure is designed for use with a canvas supported by a number of guy ropes radiating from the pole, the guy ropes preferably being housed in tunnels stitched to the canvas.

To erect such a tent the canvas is laid on the ground and the lower end of each guy rope is pegged to the ground in its proper location. Thus, the canvas is made reasonably secure against wind right from the outset. The tent pole is then taken inside the canvas and erected, with the top of the pole (which is the end to which the anchoring means are adjacent) projecting through a ring secured to the canvas, so lifting the canvas from the ground, and the bottom of the pole, or of an extension pole, driven into the ground or supported on the ground by a foot. A number of support members, equal to the number of guy ropes, are secured to the tent pole, by securing the anchoring members to the anchoring means and engaging the locating members with the locating means, the sleeve being in its raised position closest to the anchoring means. A guy rope is fixed to the guy securing element of each support member. In this condition, the arm of each support member is included downwardly from the horizontal and the guy ropes can be secured to the support members without applying any appreciable amount of tension to the guy ropes. With all the guy ropes secured to the support members, the canvas will be held substantially in its erected form. To complete erection, the sleeve is moved downwardly to its lowermost position, so causing the outer ends of the support members to be raised and the arms of the support members to become more nearly horizontal. This action fully tensions the guy ropes to support the canvas and the pegs can then be driven fully home. Erection as described can be carried out by one person even in windy conditions.

Preferably the anchoring means each takes the form of a hook, and each anchoring member is a bar engageable with the hook. The hooks may be anchored in a collar fixed by set screws to the pole. The stop means is conveniently a stop collar, which can also be fixed to the pole by set screws. Conveniently, a second stop collar is secured to the pole between the anchoring means and the first stop collar and the sleeve is slidable between the first and second stop collars, guide rods extend parallel to the post between the first and second stop collars, and the sleeve has guide holes through which the guide rods pass to align the locating means on the sleeve each with a respective one of the anchoring means. At least the upper end of the pole is preferably hollow and is formed with holes to each side of the anchoring means. These holes allow ventilation at the apex of the tent.

The invention also includes a tent pole and a support member for use in a support structure as set forth above.

DESCRIPTION OF THE PREFERRED EMBODIMENT

Figure 1:
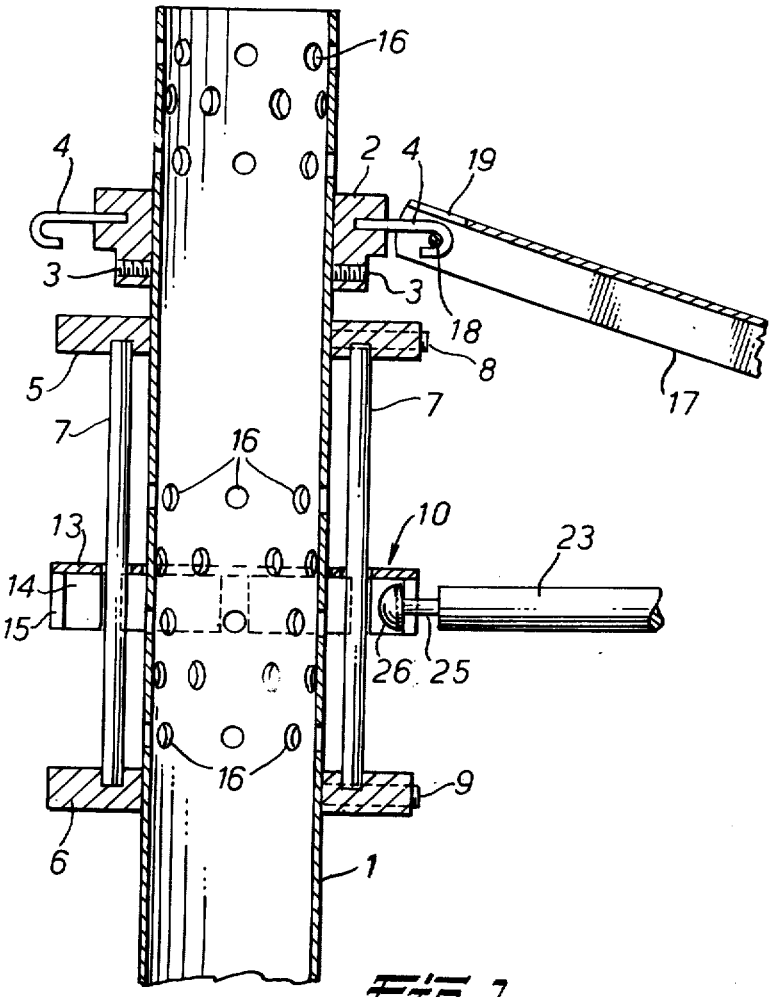
FIG. 1 is a longitudinal cross-section through the upper part of a tent pole.

As shown in FIG. 1, a hollow tent pole 1 is provided comprising a single-section pole of the required height, in which case the lower end thereof will be fitted with a spike so that it may be driven into the ground, or a foot for resting on the ground. To assist carriage, however, the pole is preferably of two sections, the upper section shown being designed to be fitted firmly to a lower section having a spike for driving into the ground, or a foot for resting on the ground.

A collar 2 fits around the upper end of the pole and is secured to the pole by set screws 3. A number of hooks 4 are anchored in the collar 2. Below the collar 2 there is a further collar 5, and below that is yet another collar 6, the two collars 5 and 6 being joined by guide rods 7 and being secured to the pole by set screws 8 and 9. A sleeve 10 is slidable on the guide rods 7 between the two collars 5 and 6 which form respective upper and lower stop means for the sleeve. A cord 11 is secured at each of its ends to the sleeve 10 and passes through holes such as 12 in the collar 6. The sleeve 10 comprises an annular top member 13 from which depends a cylindrical skirt 14 having a number of downwardly open slots 15 formed therein. The number of slots 15 is equal to the number of hooks 4 and each slot is axially aligned with one of the hooks.

The pole is formed with a number of ventilation holes 16 between the two collars 5 and 6 and above the collar 2.

Figure 2:
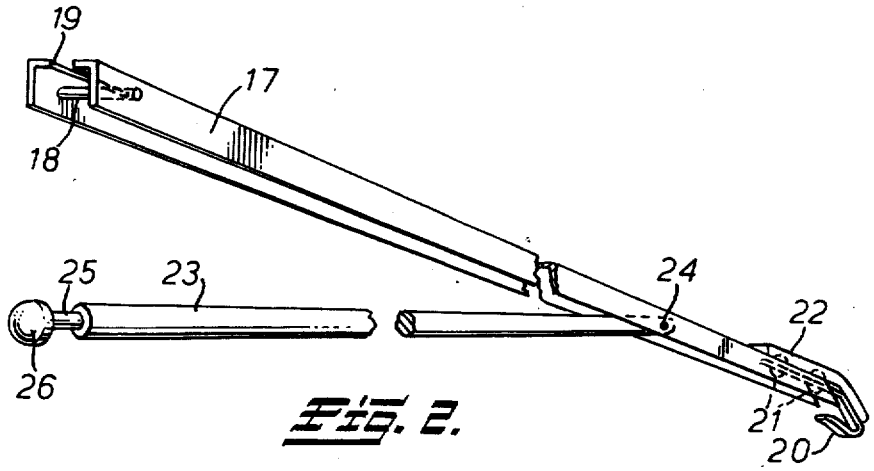
FIG. 2 is a perspective view of a support member.

The support member shown in FIG. 2 comprises an arm 17 of inverted channel-section, having at one end a bar 18 extending across the channel and engageable with one of the hooks 4, a slot 19 being formed in the top web of the arm above the bar 18. A hook 20 is secured by rivets 21 to the other end of the arm and a pad 22 of soft material, e.g., leather, is adhered over this end of the arm. A strut 23 has its first end pivoted at 24 to the arm 17 intermediate the ends thereof, and carries a locating pin 25 having an enlarged head 26 at its second end.

Use of the support structure will now be described. As shown, the pole has eight hooks 4, so eight support members are required. The structure is used with a specially made canvas 27 designed to radiate from the pole, the apex of the canvas being cut and secured to a ring 28 which fits over the top of the pole. The canvas has eight radially extending tubes or tunnels of material 29 secured thereto and a guy rope 30 passes through each tunnel, each guy rope passing through an eyelet 31 towards the lower part of the canvas and having rings such as 32, 33 at each end.

Figures 3, 5:
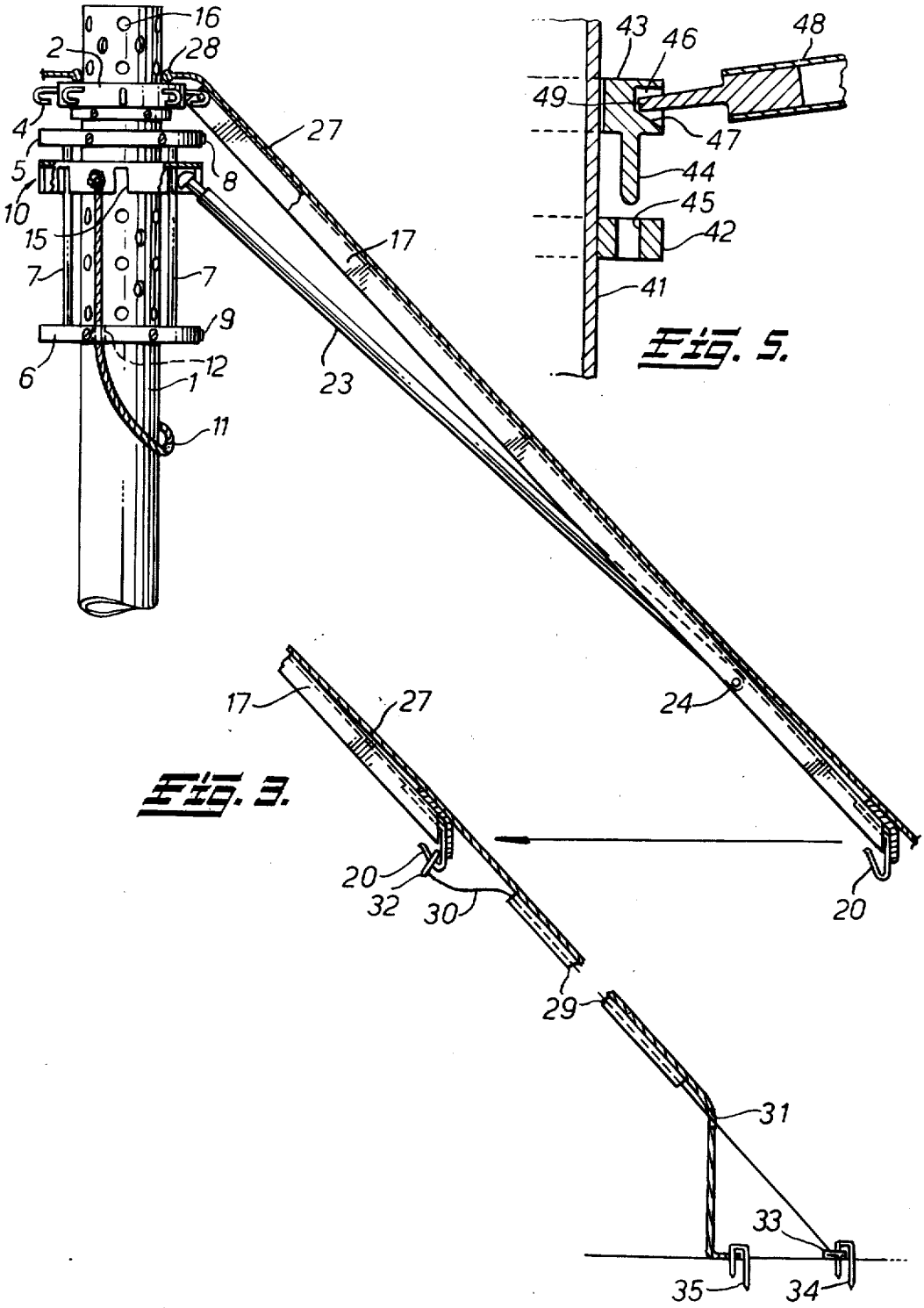
FIG. 3 is a schematic view illustrating use of a support structure during erection.
FIG. 5 shows part of a modified form of support structure.
Figure 4:
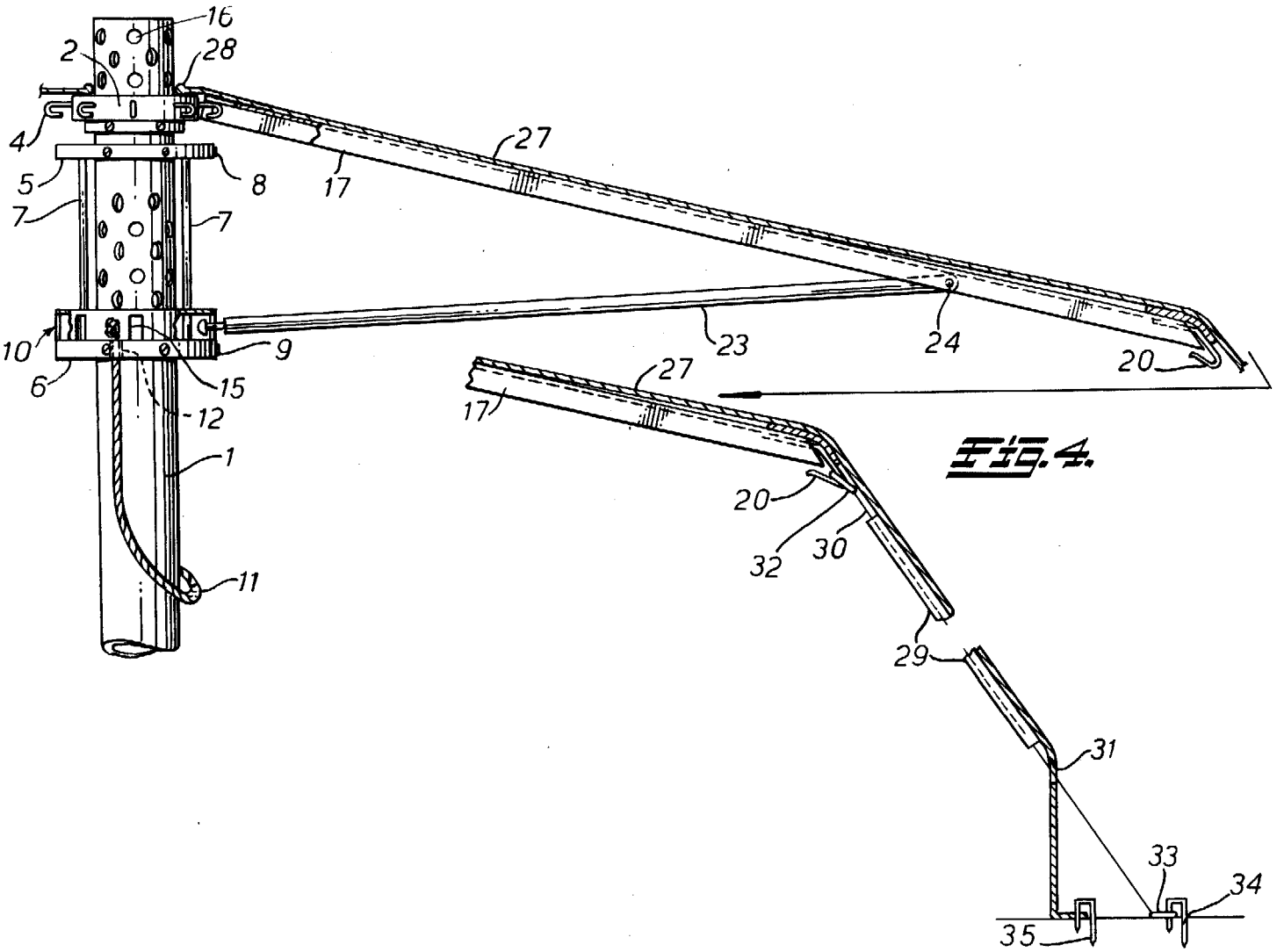
FIG. 4 is a schematic view illustrating use of a support structure in an erected tent.

To erect the tent the canvas is spread on the ground and the lower rings 33 of the eight guy ropes are pegged to the ground at the required locations by pegs 34. The pole is then taken under the canvas, the top end of the pole is fitted through the ring 28, and lifted to its upright position, the lower end of the pole being driven or supported on the ground, by way of an extension pole, if necessary. With the sleeve 10 in its raised position, as shown in FIG. 3, each support member is then fitted to the pole, by moving the end of the arm 17 upwardly, so a respective hook 4 passes through the slot 19 and engaging the bar 18 with the hook 4, and then inserting the pin 25 into a respective slot 15 from the open lower end thereof. The enlarged head 26 engages behind the slot 15 to prevent the strut 23 from pulling out of the position in which it is held relative to the sleeve 10. As the support member is at this stage supporting a certain weight of canvas, the forces due to this will prevent unwanted disengagement of the bar 18 and hook 4 and of the head 26 and sleeve 10. The ring 32 of the appropriate guy rope is then fitted over the hook 20. This procedure is repeated for all eight support members so that the upper ends of the guy ropes are all secured. The structure is then as shown in FIG. 3, but with support members fixed to all of the hooks rather than only to one as shown. In this condition the guy ropes are under no appreciable tension.

To complete erection, the cord 11 is grasped and pulled downwardly, whereupon the sleeve 10 moves downwardly into contact with the collar 6. During this action, each support member moves so that the arm 17 becomes more nearly horizontal and the strut 23 passes through an over-center position so that it is angled downwardly rather than upwardly towards the sleeve 10. As the outer ends of the arms 17 are lifted, tension is applied to the guy ropes, and the whole structure becomes braced by the guy ropes in a very rigid condition. The pegs 34 holding the rings 33 on the guy ropes can now be driven completely into the ground and the skirt of the canvas can be pegged to the ground by pegs 35. A cover, which may be stitched to the canvas, can be placed over the top of the pole to prevent rain from entering the tent.

To strike the tent, the sleeve 10 is pushed back to its uppermost position, the guy ropes are unhooked from the support members and these are removed from the pole.

Obviously, the number of hooks 4 and slots 15 may be changed as required for different sizes of tent. The length of the support members may also be selected to give a tent of a desired size. The pole is conveniently of aluminum, with internal reinforcements of stainless steel wherever necessary. The collars and the sleeve are preferably aluminum castings, and in the case of the collar 4 the collar is preferably cast around parts of pre-positioned stainless steel hooks so that these are bonded firmly to the collar. The support members are conveniently of aluminum with stainless steel parts. The materials can, if required, vary from those described and the particular arrangements described for anchoring and locating the support members on the pole and for stopping downward movement of the sleeve 10 can be changed. Thus, the hooks 4 may be directed upwardly rather than downwardly. The collar 5 and guide rods 7 may be omitted, alignment of the slots 15 with the hooks 4 then being achieved by pins from sleeve 10 engaging with guide holes in collar 9 or vice versa. Such pins and guide holes may be designed to be in engagement over the full travel of the sleeve 10, or they may engage only when the sleeve is in close proximity to the collar 6. Such a pin arrangement is shown in FIG. 5. In this modified form, a hollow pole 41 has only a single collar 42 secured thereto, acting as a lower stop means for a sleeve 43. The sleeve 43 carried pins 44 which may engage guide holes 45 when the sleeve is in close proximity to the collar. The collar, in this arrangement, also differs from that shown in the other FIGURES in that the collar is of solid construction and is formed with a plurality of locating depressions 46 around its outer circumference, the depressions being equal in number to the number of hooks secured to the pole by a collar as shown in FIG. 1, and aligned with the hooks when the pins 44 are properly engaged with the holes 45. Each depression 46 has a lower wall 47 which is angled downwardly away from the pole. Each support member for use with this pole has a strut 48 which terminates in a pin 49 for engaging a respective one of the depressions 46.

As described, the struts in both arrangements pass through an over-center or horizontal position on moving the sleeve between its upper and lower positions, and this gives a self-locking effect, holding the sleeve positively in either of its two limit positions. It is not essential that the strut pass through the over-center position, but if the struts are not angled downwardly when the collar is in the lower position then it is necessary to provide means to lock the collar in this position, for example, a bolt passed through aligned holes in the pole immediately above the collar.

I claim:

1. A support structure for a tent comprising a tent pole and a plurality of support member means which fold and unfold with respect to the pole, the support member means being freely engageable and disengageable from the pole; the pole having a plurality of anchoring means spaced apart circumferentially around the pole adjacent to the first end thereof for freely engaging and disengaging the support member means, a first stop means secured to the pole adjacent to the anchoring means, a second stop means secured to the pole and spaced along the pole from the first stop means; a sleeve slidable on the pole between the first and second stop means; and a plurality of locating means spaced apart around the circumference of the sleeve; each support member means having an arm and a strut, the arm having an anchoring member means at one end for freely engaging and disengaging the anchoring means and a guy securing element at the other end and the strut pivoted at one end intermediate the ends of the arm and having a locating member means at its free end for freely engaging and disengaging the locating means; wherein with the sleeve adjacent to the first stop means and each support member means in a folded condition the arm of each support member means has its anchoring member means freely engageable and disengageable with a respective anchoring means on the pole and the strut of each support member has its locating member means freely engageable and disengageable with a respective locating means on the sleeve and axially aligned with the respective anchoring means on the pole, so that, with the anchoring member means and anchoring means engaged and with the locating member means and locating means engaged, movement of the sleeve to adjacent the second stop means causes unfolding of the support arms to an unfolded state wherein disengagement of the anchoring member means from the anchoring means and of the locating member means from the locating means is substantially inhibited.

2. A support structure according to claim 1 in which each anchoring means is a hook.

3. A support structure according to claim 2 in which each hook is anchored in a collar which is secured to the pole adjacent to the first end thereof.

4. A support structure according to claim 3 in which each hook is bent away from the first end of the pole.

5. A support structure according to claim 1 in which each anchoring member means, is a bar engageable with the hook.

6. A support structure according to claim 5 in which the arm of the support member means is of channel-shaped cross-section and the bar extends across the channel between side walls of the arm.

7. A support structure according to claim 1 in which the first stop means comprises a first stop collar adjacent to the anchoring means.

8. A support structure according to claim 7 in which the second stop means is a second stop collar secured to the pole and spaced therealong from the first stop collar.

9. A support structure according to claim 8 in which guide rods extend parallel to the pole between the first and second stop collars, and the sleeve has guide holes through which the guide rods pass to axially align the locating means on the sleeve each with a respective one of the anchoring means.

10. A support structure according to claim 1 in which the sleeve comprises an annular member transverse to the axis of the pole and a cylindrical skirt extending from the annular member parallel to the pole and away from the first end of the pole.

11. A support structure according to claim 10 in which the locating means are each in the form of a slot in the annular skirt and having an open end away from the annular member.

12. A support structure according to claim 11 in which each locating member means is a pin projecting from the second end of the strut and formed with an enlarged head, the pin being of such a size that it will pass through the slot and the head being too large to pass through the slot.

13. A support structure according to claim 1 in which a cord is secured to the sleeve, by way of which the sleeve may be pulled from the first stop means towards the second stop means.

14. A support structure according to claim 1 in which the first end of the pole is hollow and is formed with holes to each side of the anchoring means.

15. A tent pole for use in a tent support structure, the pole having a plurality of anchoring means for detachably receiving anchoring member means spaced apart circumferentially around the pole adjacent to a first end thereof, a first stop means secured to the pole adjacent to the anchoring means, a second stop means secured to the pole and spaced along the pole from the first stop means, a sleeve slidable on the pole between the first and second stop means and a plurality of locating means for detachably receiving locating member means spaced apart around the circumference of the sleeve.

16. A tent pole according to claim 15 in which each anchoring means is a hook anchored in a collar which is secured to the pole adjacent to the first end thereof.

17. A tent pole according to claim 16 in which the first stop means comprises a first stop collar adjacent to the anchoring means.

18. A tent pole according to claim 17 in which the second stop means is a second stop collar secured to the pole and spaced therealong from the first stop collar, and the sleeve is slidable between the first and second stop collars, guide rods extend parallel to the pole between the first and second stop collars, and the sleeve has guide holes through which the guide rods pass to axially align the locating means on the sleeve each with a respective one of the anchoring means.

19. A tent pole according to claim 15 in which the sleeve comprises an annular member transverse to the axis of the pole and a cylindrical skirt extending from the annular member parallel to the pole and away from the first end of the pole, and the locating means are each in the form of a slot in the annular skirt and having an open end away from the annular member.

20. A tent support member for use in a tent support structure comprising an arm having an anchoring member means at one end for releasably engaging the tent support structure and means for securing a guy element at the other end, and a strut pivoted at one end intermediate the ends of the arm and having a locating member means for releasably engaging the tent support structure formed at its free end.

21. A support member according to claim 20 in which the arm of the support member is of channel-shaped cross-section and the anchoring member is a bar extending across the channel between side walls of the arm.

22. A support member according to claim 21 in which each locating member is a pin projecting from the second end of the strut and formed with an enlarged head.

* * * * *